US008917263B2

(12) United States Patent
Ohtsuki

(10) Patent No.: US 8,917,263 B2
(45) Date of Patent: Dec. 23, 2014

(54) METHOD OF DRIVING A LIQUID CRYSTAL PANEL BY PROVIDING A VARIABLE GATE DELAY COMPENSATION PERIOD BASED ON AMBIENT TEMPERATURE

(75) Inventor: Hideyo Ohtsuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 716 days.

(21) Appl. No.: 12/785,794

(22) Filed: May 24, 2010

(65) Prior Publication Data

US 2010/0309175 A1 Dec. 9, 2010

(30) Foreign Application Priority Data

Jun. 3, 2009 (JP) ..... 2009-134106

(51) Int. Cl.
*G09G 3/36* (2006.01)

(52) U.S. Cl.
CPC ..... *G09G 3/3648* (2013.01); *G09G 2320/041* (2013.01)
USPC ..... 345/204; 345/101

(58) Field of Classification Search
CPC ..... G09G 2320/041; G09G 2320/0223
USPC ..... 345/87–101, 204, 690
See application file for complete search history.

(56) References Cited

U.S. PATENT DOCUMENTS 4,649,383 A 3/1987 Takeda et al.
4,750,813 A * 6/1988 Ohwada et al. ..... 345/87
6,329,976 B1 * 12/2001 Johnson et al. ..... 345/101
7,071,929 B2 7/2006 Fujii
2003/0164813 A1 * 9/2003 Fujii ..... 345/101
2004/0041778 A1 * 3/2004 Hiraki et al. ..... 345/100
2007/0008274 A1 * 1/2007 Nakanishi et al. ..... 345/101
2008/0074407 A1 * 3/2008 Zhou et al. ..... 345/204
2008/0309609 A1 * 12/2008 Feng ..... 345/101
2009/0315918 A1 * 12/2009 Minami et al. ..... 345/690

FOREIGN PATENT DOCUMENTS

JP 59-123884 A 7/1984
JP 10-186326 A 7/1998
JP 2002-351426 A 12/2002
JP 2003-255304 A 9/2003
JP 2004-219824 A 8/2004
JP 2004-219933 A 8/2004

* cited by examiner

*Primary Examiner* — Jonathan Boyd
*Assistant Examiner* — James Nokham
(74) *Attorney, Agent, or Firm* — Oblon, Spivak, McClelland, Maier & Neustadt, L.L.P.

(57) ABSTRACT

Provided is a method of driving a liquid crystal panel by providing a gate delay compensation period to a timing at which gate selection signal waveforms supplied to horizontal scanning interconnections change so that a switching element changes from a conduction state to a non-conduction state with respect to a timing at which image data signal waveforms supplied to data interconnections change so that image data corresponding to display contents of a pixel electrode connected to the horizontal scanning interconnections changes to next image data, wherein an ambivalent temperature is detected to make the gate delay compensation period variable in accordance with the ambivalent temperature.

2 Claims, 4 Drawing Sheets

METHOD OF DRIVING A LIQUID CRYSTAL PANEL BY PROVIDING A VARIABLE GATE DELAY COMPENSATION PERIOD BASED ON AMBIENT TEMPERATURE

BACKGROUND OF THE INVENTION

1. Field of the Invention

The present invention relates to a method of driving a liquid crystal panel, which is preferably used in driving of an active matrix liquid crystal panel for achieving excellent display quality at ambient temperature in a range of low temperature to high temperature.

2. Description of the Background Art

In writing to pixels of a typical liquid crystal display device using an active matrix liquid crystal panel, a waveform becomes blunt due to interconnection resistance in a gate selection signal as well as an image data signal. For this reason, as commonly known in Japanese Patent Application Laid-Open No. 59-123884, signal timings thereof are set by being shifted somewhat form each other. Specifically, driving is performed such that a gate selection signal goes high to input an image data signal and then the gate selection signal goes low to end the image data signal. However, an influence of a waveform becoming blunt differs between pixels close to external input units of respective signals in a display area and pixels far therefrom, and thus timing is set so as not to incur a problem in an entire display area due to writing timing. A charging time of a pixel ranges from a rise of the image data signal to a fall of the gate selection signal.

Horizontal scanning interconnections and data interconnections of a liquid crystal panel are typically formed of metal interconnection. Thus, in a case where a liquid crystal display device is used in a wide temperature range from low temperature to high temperature, interconnection resistance becomes high at high temperature to increase an RC time constant, which increases a signal delay as well. As a result, signal waveforms of the horizontal scanning interconnections become blunt, which causes a failure in writing timing.

Although it is possible to take measures against this by adjusting timings in consideration of a signal delay due to a waveform becoming blunt at high temperature as descried in Japanese Patent Application Laid-Open No. 59-123884 (in particular, FIG. 3), unfortunately, this method reduces a charging time. A thin film transistor (hereinafter, referred to as TFT) which drives a pixel is formed of a semiconductor (amorphous Si). An on-current thereof decreases at low temperature, and thus a pixel is insufficiently charged, which leads to display unevenness. It is effective to increase a charging time for improving display at low temperature, which is difficult to be compatible with the measure against a signal delay at high temperature.

SUMMARY OF THE INVENTION

The present invention relates to a method of driving a liquid crystal panel. An object thereof is to remedy display malfunction due to a signal waveform becoming blunt at high temperature, and reduce display unevenness due to a decrease in on-current of a TFT at low temperature, to thereby achieve excellent display in a wide temperature range.

A method of driving a liquid crystal panel according to the present invention relates to a driving method for a liquid crystal panel which is configured to perform conduction control on a plurality of switching elements connected to a plurality of pixel electrodes surrounded by a plurality of horizontal scanning interconnections and a plurality of data interconnections by gate selection signals supplied through the horizontal scanning interconnections to supply image data signals supplied from the data interconnections to the pixel electrodes via the switching elements. In this driving method, the liquid crystal panel is driven by providing a gate delay compensation period to a timing at which gate selection signal waveforms supplied to the horizontal scanning interconnections change so that the switching elements change from a conduction state to a non-conduction state with respect to a timing at which image data signal waveforms supplied to the data interconnections change so that image data corresponding to display contents of the electrode pixels connected to the horizontal scanning interconnections changes to the next image data. The driving method is characterized in that an ambient temperature of the liquid crystal panel is detected to make the gate delay compensation period variable in accordance with the ambient temperature.

Accordingly, a display malfunction due to the signal waveform becoming blunt at high temperature is remedied, and display unevenness due to a decrease in on-current of the TFT at low temperature is reduced, which makes it possible to achieve excellent display in a wide temperature range.

DESCRIPTION OF THE PREFERRED EMBODIMENTS

Figure 1:
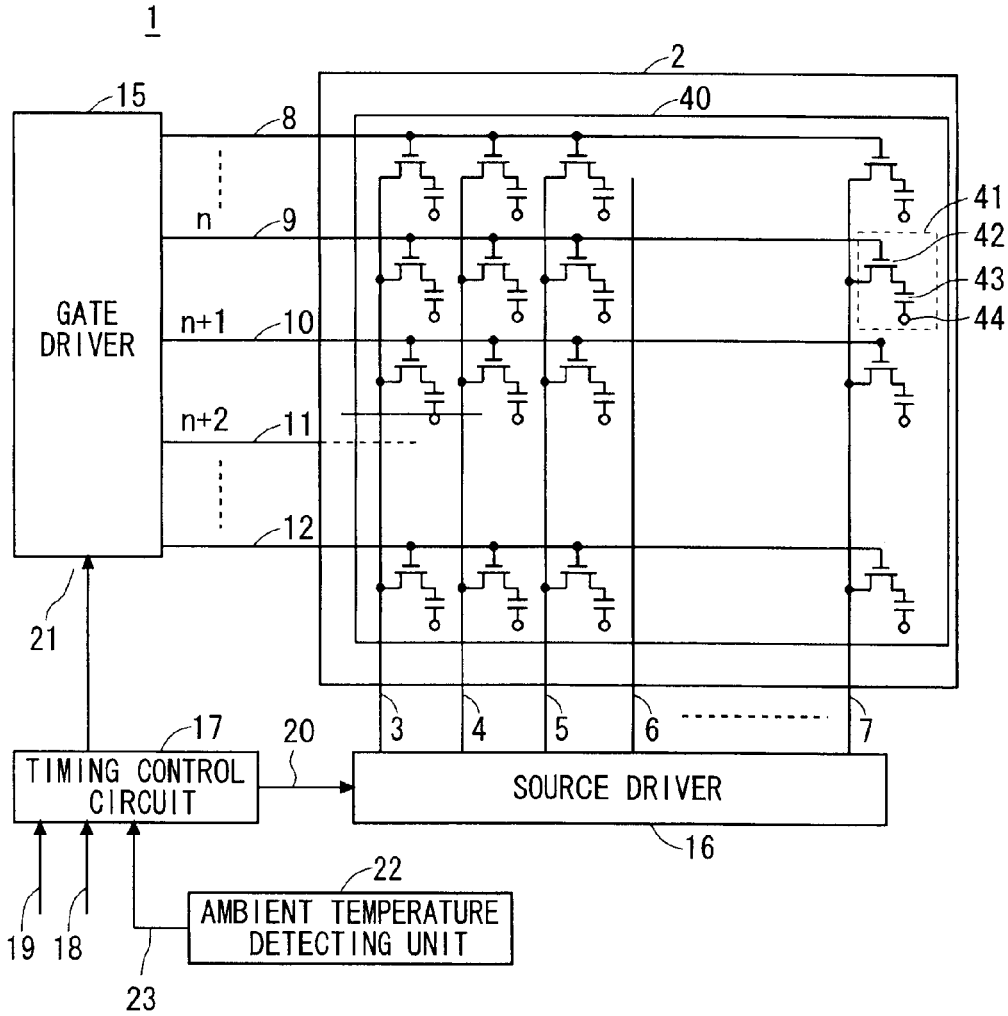
FIG. 1 is a system configuration diagram showing a configuration of a liquid crystal display device according to a first preferred embodiment.

Preferred embodiments of the present invention will be described below with reference to the drawings. Note that for avoiding redundant description, elements having the same or equivalent function are denoted by the same or like reference numerals.

First Preferred Embodiment

FIG. 1 is a system configuration diagram showing a schematic configuration of a liquid crystal display device 1 according to a first preferred embodiment. In FIG. 1, a liquid crystal panel 2 is formed by bonding an active matrix substrate 40 and a counter substrate (not shown) opposed thereto with a gap therebetween, and liquid crystal (not shown) is held in the gap. The active matrix substrate 40 includes a plurality of data interconnections 3, 4, 5, 6 and 7 and a plurality of horizontal scanning interconnections 8, 9, 10, 11 and 12 which are formed in matrix to intersect each other. For simplification of description, a configuration of one specific pixel unit is now described in detail, and the entire liquid crystal panel 2 will be described thereafter.

Here, as to pixels constituting a display area of the liquid crystal panel 2, description is given by means of a representative pixel unit 41 indicated by a broken line. In FIG. 1, the pixel unit 41 is positioned in the rightmost column in the display area, and is arranged at an intersecting part of the data interconnection 7 and the horizontal scanning interconnection 9. In addition, the pixel unit 41 includes a TFT 42 as a switching element and a pixel electrode 43, and the horizontal scanning interconnection 9, the data interconnection 7 and the pixel electrode 43 are connected to a gate electrode of the TFT 42, a source electrode thereof and a drain electrode thereof, respectively. The pixel electrode 43 forms a capacitor between itself and a counter electrode 44 which is an electrode of the counter substrate with liquid crystal sandwiched therebetween. The TFT 42 is turned on when a gate selection signal applied to the horizontal scanning interconnection 9 goes into a high level, whereby a potential of the data interconnection 7 at that time, that is, an image data signal is written in the pixel electrode 43. Then, the gate selection signal goes into a low level after a lapse of one horizontal period, and the TFT 42 is turned off, whereby the written potential is held in the capacitor for one frame period or longer. In the first preferred embodiment, so-called dot inversion driving is performed, and thus vertically-adjacent pixel units are driven by image data signal waveforms having polarities opposite to each other.

Further, a gate driver 15 is connected as a horizontal scanning interconnection drive circuit to respective left end parts of the horizontal scanning interconnections 8, 9, 10, 11 and 12 of the liquid crystal panel 2, and a source driver 16 is connected as a data interconnection drive circuit to respective lower end parts of the data interconnections 3, 4, 5, 6 and 7, which are individually controlled by a timing control circuit 17.

The timing control circuit 17 performs gradation correction and timing adjustment by a video signal 18 which are input from an external display controller (not shown), and a display control signal 19 composed of a display clock, a horizontal synchronization signal, a vertical synchronization signal and the like, and outputs a display control data signal 20 to the source driver 16. In addition, the timing control circuit 17 outputs a horizontal scanning control signal 21 to the gate driver 15.

Further, am ambient temperature detecting unit 22 is connected to the timing control circuit 17. The ambient temperature detecting unit 22 detects an ambient temperature of the liquid crystal display panel 2 and outputs temperature information 23 thereof to the timing control circuit 17.

Figure 2:
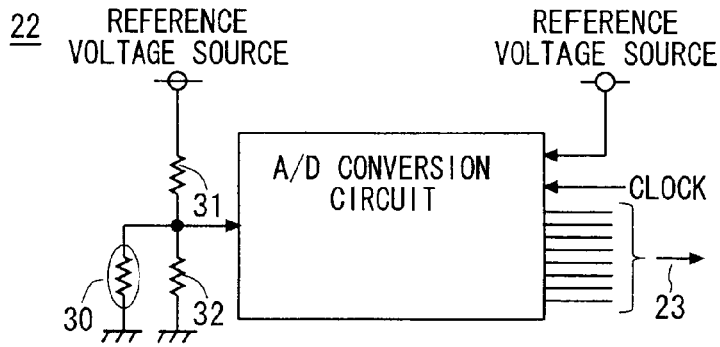
FIG. 2 is a block diagram showing a configuration example of an ambient temperature detecting unit shown in FIG. 1.

Next, FIG. 2 shows a configuration of the ambient temperature detecting unit 22. In FIG. 2, reference numeral 30 denotes a temperature sensor, which is formed of a thermistor or the like whose resistance value increases along with, for example, temperature rise. A voltage of a reference voltage source is divided into appropriate voltages by the temperature sensor 30 and adjusting resistors 31 and 32, and a voltage range thereof is adjusted. After that, the divided voltages are input to an analog/digital (A/D) conversion circuit, whereby the temperature information 23 is output to the timing control circuit 17 as digital data being in correlation with the ambient temperature. From the input temperature information 23, video signal 18 and display control signal 19, the timing control circuit 17 outputs the horizontal scanning control signal 21 and the display control data signal 20 which are appropriate for the ambient temperature to the gate driver 15 and the source driver 16, respectively.

Here, a gate selection signal of the liquid crystal panel 2 is input from the left side of the display area in FIG. 1, whereas an image data signal is input from the lower side of the display area. The horizontal scanning interconnections and the data interconnections which are positioned within the liquid crystal panel 2 are metal interconnections, and for example, are configured by using, for example, an alloy of Al or Cr. In an active matrix liquid crystal panel, a semiconductor layer of the TFT is formed of amorphous Si that is the most typical one.

Figure 3:
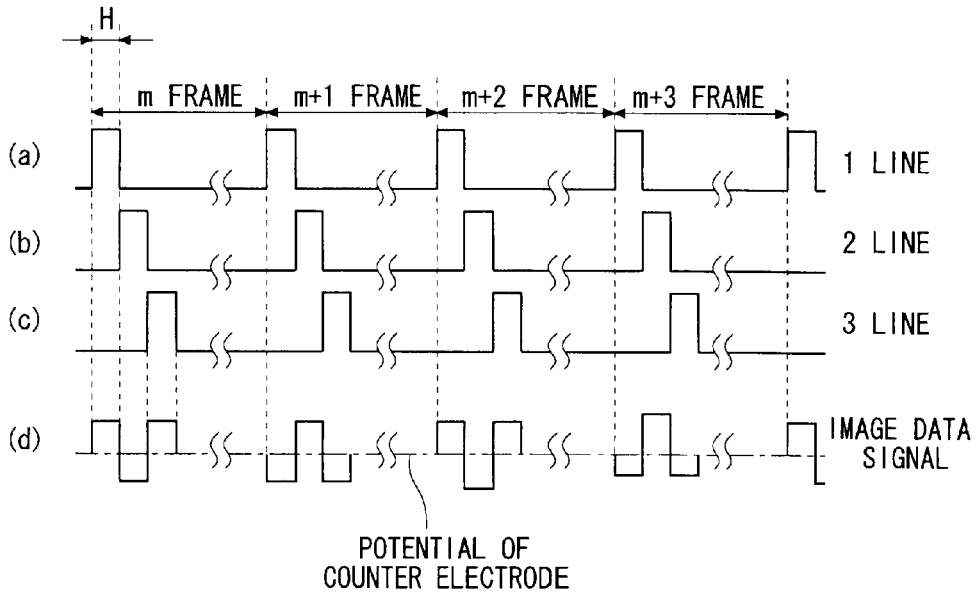
FIG. 3 is a timing chart of gate selection signal waveforms and an image data signal of the liquid crystal display device according to the first preferred embodiment.

Next, with reference to FIG. 3, schematic waveforms of the gate selection signal and image data signal according to the first preferred embodiment of the present invention will be described. Parts (a), (b) and (c) of FIG. 3 show consecutive gate selection signals for three lines starting from the horizontal scanning interconnection 8 (first line), which show waveform behaviors among successive frames of an m frame, an m+1 frame, an m+2 frame and an m+3 frame. Part (d) of FIG. 3 shows a behavior of an image data signal of the data interconnection 7 of FIG. 1. As commonly known, in driving of an active matrix liquid crystal panel, one horizontal cycle period (H) is considered to be one cycle, and the rows are successively driven row by row from the uppermost row (horizontal scanning interconnection 8) toward the lowermost row (horizontal scanning interconnection 12), where an image for one frame is displayed.

As described above, dot inversion driving is employed in this preferred embodiment. Accordingly, the image data signal shown in Part (d) of FIG. 3 changes its polarity per horizontal cycle (H). An image data waveform of a data interconnection adjacent to the data interconnection 7 has a polarity opposite to that of the image data signal shown in Part (d) of FIG. 3, though not shown.

Figure 4:
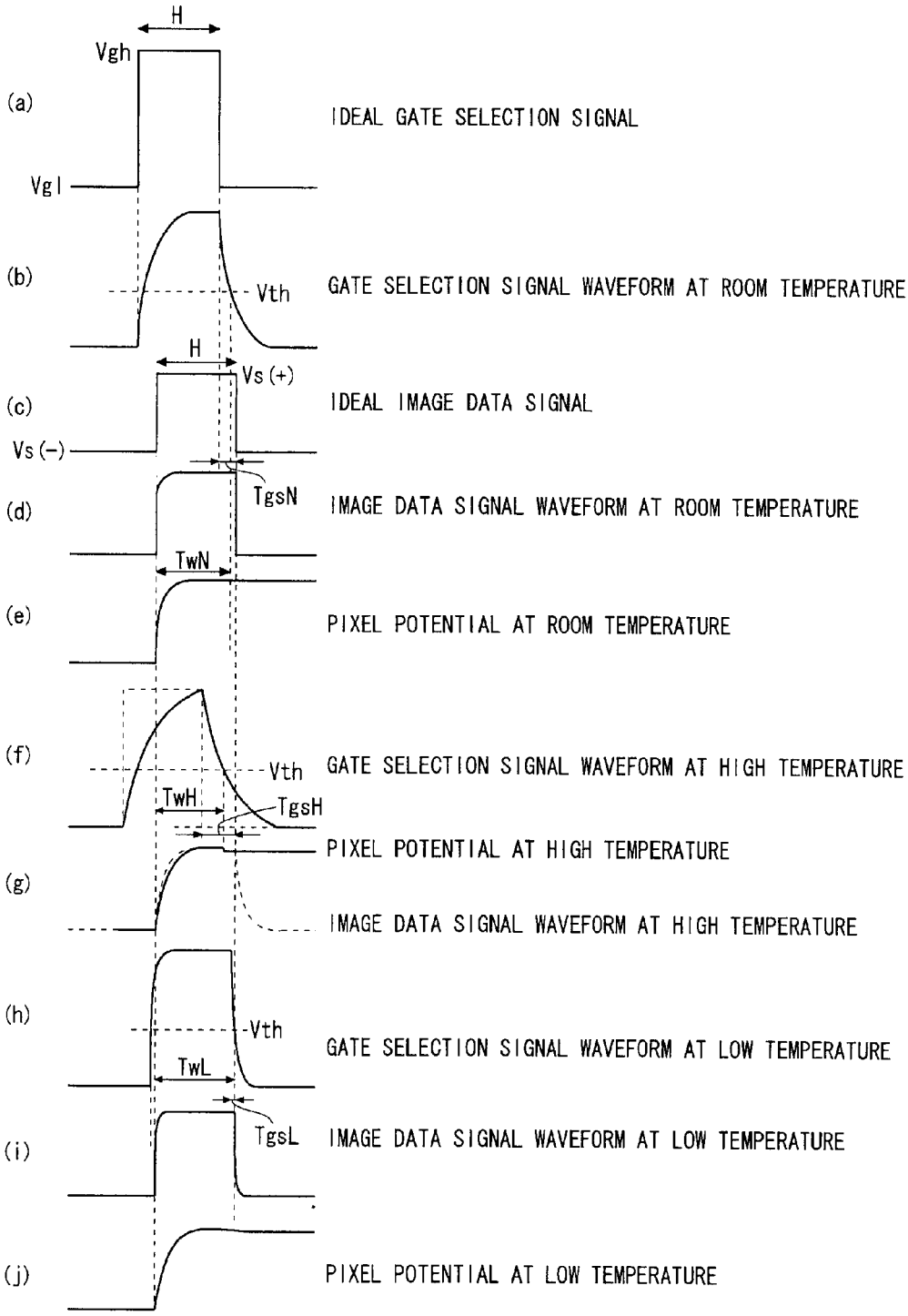
FIG. 4 is a waveform chart showing time relations between an ambient temperature and a gate selection signal waveform, an image data signal and a pixel potential of the liquid crystal display device according to the first preferred embodiment.

FIG. 4 is a waveform chart showing time relations between the ambient temperature and a gate selection signal waveform, an image data signal and a pixel potential of a specific pixel unit of the liquid crystal display device according to the first preferred embodiment. Taking the pixel unit 41 connected to the horizontal scanning interconnection 9 as the specific pixel unit, a part of the high level period (one horizontal period) of a plurality of gate selection signals shown in FIG. 3 corresponds to a gate selection signal waveform in Part (a) of FIG. 4. Next, a gate selection signal waveform at room temperature (for example, 25° C.) shown in Part (b) of FIG. 4 is an example of a case of a side far from a gate selection signal input side (left end of FIG. 1). That is, taking FIG. 1 as an example, it is a case of the right end area of the display area (for example, pixel unit 41). Compared with an ideal gate selection signal shown in Part (a) of FIG. 4, due to influences of an interconnection resistance of the horizontal scanning interconnection and a stray capacitor (not shown), the gate selection signal waveform at room temperature has a certain degree of RC time constant of interconnection, where a waveform becomes blunt and a gate selection signal is delayed. In FIG. 4, Vgh, Vgl, Vs(+) and Vs(−) denote a gate positive voltage, a gate negative voltage, a positive-side potential of an image data signal and a negative-side potential thereof, respectively. In addition, Vth denotes an ON/OFF threshold voltage of the TFT.

Similarly, an image data signal waveform at room temperature which is shown in Part (d) of FIG. 4 becomes blunt in accordance with a distance from an input terminal of the data interconnection, with respect to an ideal image data signal shown in Part (c) of FIG. 4 (for example, pixel unit 41).

As shown in Parts (a) and (c) of FIG. 4, driving periods of both the ideal gate selection signal and the image data signal waveform are one horizontal cycle period (H). There is a fear that a delay of the gate selection signal may cause a situation where a polarity of the image data signal changes prior to a fall timing of the gate selection signal, and accordingly an appropriate potential may not be written in a pixel. As a measure against this, as shown in Part (c) of FIG. 4, driving is performed in such a manner that rise/fall timings of the gate selection signal are advanced compared with a timing at which a polarity of the image data signal changes by an amount of a gate delay compensation period "TgsN" (hereinafter, "rise of a gate selection signal" refers to a timing at which a TFT connected to the interconnection thereof changes form a non-conduction state to a conduction state, and "fall of a gate selection signal" refers to a timing at which a TFT changes from a conduction state to a non-conduction state). As a result, as to a transition of a pixel potential of a pixel (for example, pixel unit 41) at room temperature, a rise of the pixel potential is approximately in synchronization with a polarity change of an image data signal, as shown in Part (e) of FIG. 4, to have a rising waveform corresponding to a driving ability of a TFT at room temperature. Then, a gate selection signal falls prior to the timing at which the polarity of the image data signal changes, and a pixel potential corresponding to image data is approximately maintained thereafter. Accordingly, a charging period of the pixel unit is "TwN" which is shown in Part (d) of FIG. 4. The gate delay compensation period "TgsN" is determined based on a waveform simulation, an actually measured value and the like, in consideration of a resolution of a liquid crystal panel, a size of the panel, an interconnection material, a driving ability of a TFT, and further a relatively small delay amount in a pixel unit on a gate selection signal input side (left end of FIG. 1) of the liquid crystal panel.

Next, description will be given of characteristic changes of respective component members and measures against those in a case where the liquid crystal display device is used in a high temperature environment (for example, 50° C.). Metal typically has a higher interconnection resistance in a high temperature environment. In a liquid crystal panel whose horizontal scanning interconnections and data interconnections are both formed of metal, an RC time constant of interconnections increases along with an increase in interconnection resistance. Accordingly, as shown in Part (f) of FIG. 4, a signal delay increases, which is caused due to a gate selection signal becoming blunt for a large amount, and if the gate delay compensation period remains "TgsN", the timing at which the polarity of the image data signal changes may arrive prior to falling of the gate selection signal. As a result, image data of the opposite polarity may be written in the pixel unit, and thus an appropriate pixel potential cannot be maintained.

Against this problem, as shown by a symbol "TgsH" in Part (f) of FIG. 4, there is taken a measure in such a manner that a gate delay compensation period (shift amount) between the fall timing of the gate selection signal and the timing at which the polarity of the image data signal changes is increased compared with that at room temperature. On this occasion, a charging period of a pixel reduces compared with "TwN" as shown by a symbol "TwH" in Part (f) of FIG. 4. However, the TFT employed in this preferred embodiment is an amorphous Si TFT, and an on-current of the semiconductor increases along with a temperature rise, together with an increase in carrier density. A driving ability of the TFT at high temperature is improved as described above. Therefore, even in consideration of a short charging period of the pixel and a waveform which becomes blunt due to an interconnection resistance increase of the data interconnection, a pixel of an image data signal at high temperature which is indicated by a broken line in Part (g) of FIG. 4 is charged up to a potential corresponding to the image data, as a pixel potential waveform at high temperature indicated by a solid line in Part (g) of FIG. 4. Accordingly, display quality due to insufficient charging hardly occurs.

Next, description will be given of characteristic changes of respective component members and measures against those in a case where the liquid crystal display device is used in a low temperature environment (for example, 0° C.). In a semiconductor of amorphous Si TFT. carrier density decreases as temperature decreases, and thus an on-current decreases. This leads to a fear that a pixel may be charged insufficiently due to a low TFT driving ability at low temperature. On the other hand, interconnection resistances of the horizontal scanning interconnections and data interconnections decrease along with ambient temperature decreases. As a result, a signal waveform becomes less blunt as shown in Parts (h) and (i) of FIG. 4. For this reason, the gate delay compensation periods of the horizontal scanning interconnections and data interconnections are reduced as indicated by a symbol "TgsL" in Part (h) of FIG. 4. The gate delay compensation period "TgsL" is reduced at low temperature, and the charging time is increased to "TwL", to thereby compensate for a shortage of driving ability of the TFT at low temperature. Accordingly, it is possible to improve pixel charging characteristics as shown in Part (j) of FIG. 4.

On the other hand, as to the gate delay compensation period (shift amount), shift amounts corresponding to, for example, 70° C., 50° C., 25° C., 0° C. and −20° C. are implemented by a look-up table (hereinafter, referred to as LUT) to be contained in the timing control circuit 17, to thereby switch reference addresses of the LUT through control of an external signal. As a value of the gate delay compensation period (shift amount), for example, a value such as the number of internal clocks used in the timing control circuit may be stored. This value is read from the LUT in accordance with the reference address to be set as an initial value of a counter, and the counter is caused to perform subtraction operation with the internal clock as a counter source, which makes it possible to measure a period up to zero as the gate delay compensation period (shift amount).

As described above, the gate delay compensation period (shift amount) stored in the LUT is determined based on a waveform simulation, an actually measured value and the like, in consideration of a resolution of a liquid crystal panel, a size of the panel, interconnection material characteristics, a driving ability of a TFT at each temperature, a delay amount of a data interconnection, and further delay amounts in a pixel unit on the gate selection signal input side of the liquid crystal panel and a pixel unit farthest form the input side.

In addition, as to control of an external signal, a predetermined control signal may be input from an outside of the liquid crystal display device 1, to thereby switch reference addresses of the LUT. Alternatively, the ambient temperature detecting unit 22 may be placed in the liquid crystal display device as shown in FIG. 1, to thereby switch reference addresses of the LUT based on an output of the ambient temperature detecting unit 22. Under ambient temperature conditions other than temperatures prepared in the LUT, interpolation operation is performed from a value of the LUT, which prevents the gate delay compensation period from changing at wide intervals in a case where temperature slightly changes.

Alternatively, as to the interpolation operation, hysteresis may be provided to a temperature change so as to prevent a change in gate delay compensation period with respect to minute fluctuations in temperature.

In place of particularly providing an LUT, there may be employed a configuration in which an appropriate gate delay compensation period is obtained from a certain operational expression based on ambient temperature data input from the ambient temperature detecting unit 22.

The gate delay compensation period of the liquid crystal panel is switched to change a driving timing, in accordance with temperature as described above, whereby it is possible to improve display quality at low temperature as well as high temperature.

Second Preferred Embodiment

Figure 5:
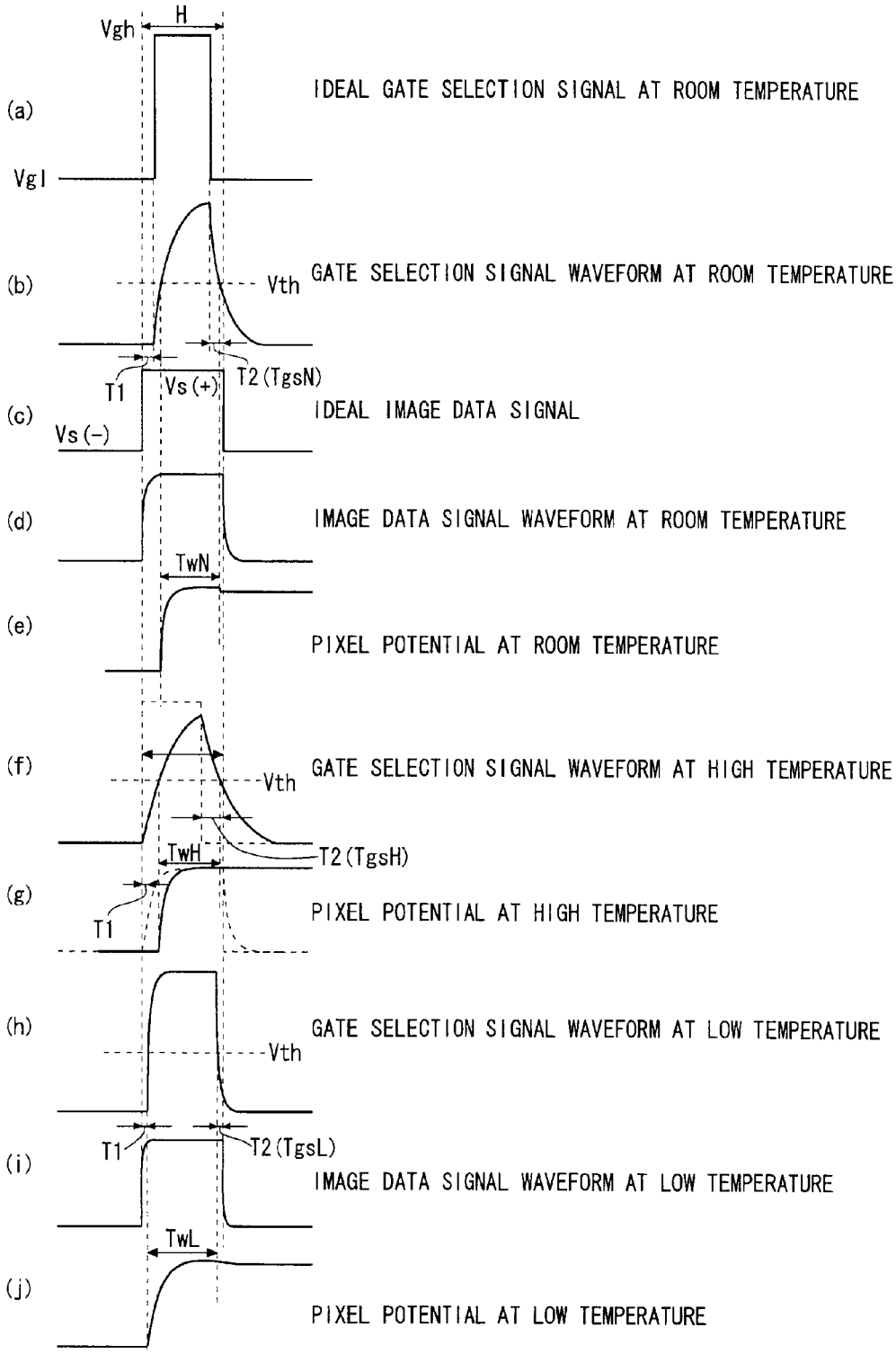
FIG. 5 is a waveform chart showing time relations between an ambient temperature and a gate selection signal waveform, an image data signal and a pixel potential of a liquid crystal display device according to a second preferred embodiment.

FIG. 5 is a waveform chart showing time relations between an ambient temperature of the liquid crystal panel and a gate selection signal waveform, an image data signal and a pixel potential of a liquid crystal display device according to a second preferred embodiment. Differently from the gate selection signal waveform of FIG. 3 which has been described in the first preferred embodiment, in the second preferred embodiment, a blanking period which will be described below is provided between gate selection signals between adjacent ones of the horizontal scanning interconnections 9 (n line), 10 (n+1 line) and 11 (n+2 line). Other configuration is similar to that of the first preferred embodiment described above, and thus detailed description thereof will be omitted here.

In FIG. 5, two linear chain lines represent one horizontal cycle period and coincide with a polarity change timing at which an ideal image data signal changes from Vs(+) to Vs(−) or from Vs(−) to Vs(+) as shown in Part (c) FIG. 5, which is a reference time described below. Further, also in the second preferred embodiment, the liquid crystal panel 2 is driven from the uppermost row (horizontal scanning interconnection 8) in order with one horizontal cycle period as one cycle, and is successively driven row by row toward the lowermost row (horizontal scanning interconnection 12).

Compared with one horizontal cycle period (H), an ideal gate selection signal at room temperature (for example, 25° C.) shown in Part (a) of FIG. 5 is shorter by an amount of a T1 period in the front of the cycle and by an amount of a T2 period in the rear of the cycle. Here, the T1 period and T2 period are referred to as blanking periods of the gate selection signal, where symbols T1 and T2 are referred to as a front blanking period and a rear blanking period, respectively. In particular, the rear blanking period T2 corresponds to the gate delay compensation period TgsN according to the first preferred embodiment described above.

As to an actual gate selection signal waveform at room temperature, a waveform becomes blunt by influences of RC components due to interconnection resistance of a horizontal scanning interconnection and a stray capacitor to be a waveform shown in Part (b) of FIG. 5. Further, as to an image data signal waveform, compared with the ideal image data signal waveform shown in Part (c) of FIG. 5, a waveform becomes blunt, to thereby become a waveform shown in Part (d) of FIG. 5. In a case where an ambient temperature is a room temperature as shown in Parts (a) to (d) of FIG. 5, the blanking periods of the gate selection signal are as follows. The front blanking period T1 is secured such that an image data signal in Part (d) of FIG. 5 rises and then the gate selection signal rises, and the rear blanking period T2 is determined such that the image data signal in Part (d) in FIG. 5 becomes equal to or smaller than Vth, a waveform falls, and then a polarity of the image data signal in Part (d) of FIG. 5 changes. As indicated by "TwN" in Part (d) of FIG. 5, a charging period of a pixel unit becomes a period in which the gate selection signal is equal to or larger than Vth of the TFT. In this case, as described above, the front/rear blanking periods are determined based on a waveform simulation, an actually measured value and the like, in consideration of a resolution of a liquid crystal panel, a size of the panel, interconnection material characteristics, a driving ability of a TFT at each temperature, and further delay amounts in a pixel unit on the gate selection signal input side of the liquid crystal panel and a pixel unit farthest form the input side.

In a case where an ambient temperature of a liquid crystal panel is high (for example, 50° C.), an interconnection resistance of the horizontal scanning interconnection rises as described above, and a waveform becomes blunt greatly in a gate selection signal shown in Part (f) of FIG. 5, whereby a delay amount increases compared with that at room temperature. Further, an interconnection resistance increases also in the data interconnection, and an image data signal waveform becomes blunt as indicated by a broken line in Part (g) of FIG. 5, whereby a waveform poorly rises. Accordingly, at high temperature, the front blanking period T1 is set to approximately zero as shown in Parts (f) and (g) of FIG. 5, and is secured such that the image data signal rises and then the gate selection signal rises. On the other hand, the rear blanking period T2 (which corresponds to the gate delay compensation period TgsH) is set to be larger than that at room temperature. As indicated by "TwH" in Part (f) of FIG. 5, a charging period of a pixel unit becomes a period in which a gate selection signal is equal to or larger than Vth of the TFT. In this case, a driving ability of the TFT is large at high temperature as described above, whereby it is possible to write an image data signal in a pixel unit even if a rise delay of the gate selection signal is large. Moreover, a delay of the image data signal is also large as described above, and thus an image data signal of a preceding row is not written inadvertently even if the front blanking period T1 is set to approximately zero.

On the other hand, the rear blanking period T2 is set such that a gate selection signal falls (becomes Vth or smaller) sufficiently prior to polarity change of an image data signal (=image data of the next row) to prevent inadvertent writing even in consideration of a delay amount of a gate selection signal in a pixel unit farthest from the input side. A transition of a pixel potential at high temperature in the case where the front/rear blanking periods T1 and T2 are set as described above is indicated by a solid line in Part (g) of FIG. 5.

In a case where the ambient temperature is low (for example, 0° C.), an interconnection resistance of the horizontal scanning interconnection is small as described above, and a waveform of the gate selection signal shown in Part (h) of FIG. 5 becomes less blunt, whereby a delay amount is smaller than that at room temperature. In addition, an interconnection resistance decreases also in the data interconnection, and thus a waveform of an image data signal rises excellently as shown in Part (i) of FIG. 5. However, a driving ability of the TFT reduces at low temperature as described above, and accordingly a sufficient writing time TwL at low temperature is required. Therefore, at low temperature, the front blanking period T1 and the rear blanking period T2 (corresponding to the gate delay compensation period TgsL) are both set to be relatively small as shown in Parts (h) and (i) of FIG. 5. Also in this case, the front blanking period T1 is secured such that the image data signal rises and then the gate selection signal rises, and the rear blanking period T2 is set such that the a timing at which the polarity of the image data signal changes arrives after the fall of the gate selection signal. A transition of a pixel potential at low temperature in this case is shown in Part (j) of FIG. 5.

As to the front/rear blanking periods T1 and T2, time values corresponding to, for example, 70° C., 50° C., 25° C., 0° C. and −20° C. may be implemented by an LUT to be contained in the timing control circuit 17, to thereby control switching of reference addresses of the LUT from an outside of the liquid crystal display device 1 as in the first preferred embodiment. Alternatively, the reference addresses of the LUT may be switched based on the output of the ambient temperature detecting unit 22 contained in the liquid crystal display device 1.

Note that dot inversion driving has been described as an example of a method of driving a liquid crystal panel in the first and second preferred embodiments. In a similar manner, the present invention is performed by line inversion driving in which pixel units belonging to one row are driven with the same polarity to reverse polarities every adjacent rows.

Further, in addition to the first and second preferred embodiments, in a case of improving an on-current of a TFT, it is possible to improve a charging ability at much lower temperature, which enables improvements of display quality at lower temperature.

While the invention has been shown and described in detail, the foregoing description is in all aspects illustrative and not restrictive. It is therefore understood that numerous modifications and variations can be devised without departing from the scope of the invention.

What is claimed is:

1. A method of driving a liquid crystal panel, the liquid crystal panel being configured to perform conduction control on a plurality of switching elements connected to a plurality of pixels electrodes surrounded by a plurality of horizontal scanning interconnections and a plurality of data interconnections by gate selection signals supplied through said horizontal scanning interconnections to supply image data signals supplied from said data interconnections to said pixel electrodes via said switching elements, the method comprising:

detecting an ambient temperature of said liquid crystal panel; and driving said liquid crystal panel based on a variable gate delay compensation period, which varies based on the ambient temperature, and that is a period between a timing at which gate selection signal waveforms supplied to said horizontal scanning interconnections change so that said switching elements change from a conduction state to a non-conduction state and a timing at which image data signal waveforms supplied to said data interconnections change so that image data corresponding to display contents of said pixel electrodes connected to said horizontal scanning interconnections changes to next image data, wherein a first time period value of the variable gate delay compensation period, when the ambient temperature of the liquid crystal panel is high, is set to be longer than a second time period value of the variable gate delay compensation period when said ambient temperature is normal, and a third time period value of the variable gate delay compensation period, when said ambient temperature is low, is set to be shorter than the second time period value of the variable gate delay compensation period.

2. The method of driving a liquid crystal panel according to claim 1, wherein the variable gate delay compensation period is set based on a look-up table that associates each of a plurality of ambient temperatures, including said ambient temperature, with a corresponding one of the first time period value, the second time period value, and the third time period value of the variable gate delay compensation period, the look-up table being stored in a timing control circuit of the liquid crystal panel.

* * * * *